US006201379B1

(12) United States Patent
MacQuigg et al.

(10) Patent No.: US 6,201,379 B1
(45) Date of Patent: Mar. 13, 2001

(54) CMOS VOLTAGE REFERENCE WITH A NULLING AMPLIFIER

(75) Inventors: David R. MacQuigg; Mark J. Mercer, both of Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/416,899

(22) Filed: Oct. 13, 1999

(51) Int. Cl.[7] ..... G05F 3/16; G05F 3/20

(52) U.S. Cl. ..... 323/313; 323/316

(58) Field of Search ..... 323/313, 314, 323/315, 316

(56) References Cited

U.S. PATENT DOCUMENTS

| | | | | |
|---|---|---|---|---|
| Re. 35,951 | * | 11/1998 | Ganesan et al. | 323/313 |
| 3,887,863 | | 6/1975 | Brokaw | 323/19 |
| 4,190,805 | | 2/1980 | Bingham | 330/9 |
| 4,250,445 | | 2/1981 | Browkaw | 323/313 |
| 4,543,522 | | 9/1985 | Morean | 323/303 |

(List continued on next page.)

OTHER PUBLICATIONS

B. Song and P.R. Gray, "A Precision Curvature–Compensated CMOS Bandgap Reference," *JSSC,* pp. 634–643, Dec. 1983.

Holman, Timothy, "A New Temperature Compensation Technique for Bandgap Voltage References," *ISCAS,* pp. 385–388, 1996, No Month.

Rincon–Mora, G.A. and Allen, P.E., A1.1V Current $_{13}$Mode and Piecewise–Linear Curvature–Corrected Bandgap Reference, *JSSC,* pp. 1551–1554, Mar. 1998.

Gray, P.R. and Meyer, R.G., "Band–Gap Referenced Biasing Circuits," section A4.3.2 in *Analysis and Design of Analog Integrated Circuits,* 3rd ed., No Date.

Sze, S.M., "Carrier Transport Phenomena," section 1.5 in *Physics of Semiconductor Devices,* 2nd ed. (Wiley, 1981), No Month.

Annema, Anne–Johan, "Low–Power Bandgap References Featuring DTMOST's," *IEEE Journal of Solid–State Circuits,* vol. 34, No. 7, pp. 949–955, Jul. 1999.

Banba, Hironori et al., "A CMOS Bandgap Reference Circuit with Sub–1–V Operation," *IEEE Journal of Solid–State Circuits,* vol. 34, No. 5, pp. 670–673, May 1999.

Sudha, Maramreddy and Holman, W. Timothy, "A Low Noise Sub–Bandgap Voltage Reference," *IEEE,* pp. 193–196, 1997, No Month.

Pease, Robert A., "The Design of Band–Gap Reference Circuits: Trials and Tribulations," *IEEE 1990 Bipolar Circuits and Technology Meeting 9.3*pp. 214–218, 1990 No Month.

Lin, S.L. and C.A.T. Salama, "Regular Correspondence," *IEEE Journal of Solid–State Circuits,* vol. SC–20, No. 6, pp. 1283–1285, Dec. 1985.

Michejda, John and Kim, Suk. K., "A Precision CMOS Bandgap Reference," *IEEE Journal of Solid–State Circuits,* vol. SC–19, No. 6, pp. 1014–1021, Dec. 1984.

(List continued on next page.)

*Primary Examiner*—Peter S. Wong
*Assistant Examiner*—Bao Q. Vu
(74) *Attorney, Agent, or Firm*—Beyer Weaver & Thomas, LLP

(57) ABSTRACT

A CMOS voltage reference comprises a band-gap core, a primary amplifier and a "nulling" amplifier. The voltage reference may also include slope, level and curvature trim circuits to provide a low-cost CMOS voltage reference that can be trimmed after final packaging. Due to the nulling of the errors from other sources by the nulling amplifier, the trim circuits are able to adjust the variations from the band-gap core. The nulling amplifier uses switching techniques to provide an accurate null, but is configured to avoid injecting switch transients into the voltage reference output.

22 Claims, 13 Drawing Sheets

U.S. PATENT DOCUMENTS

| | | | | |
|---|---|---|---|---|
| 4,603,291 | | 7/1986 | Nelson | 323/315 |
| 4,604,584 | * | 8/1986 | Kelley | 330/9 |
| 4,613,809 | | 9/1986 | Skovmand | 323/268 |
| 4,622,512 | * | 11/1986 | Brokaw | 323/313 |
| 4,728,881 | * | 3/1988 | Evans et al. | 323/353 |
| 4,792,747 | | 12/1988 | Schroeder | 323/303 |
| 4,803,612 | | 2/1989 | Skovmand | 323/284 |
| 4,808,908 | | 2/1989 | Lewis et al. | 323/313 |
| 4,902,959 | | 2/1990 | Brokaw | 323/314 |
| 4,906,913 | | 3/1990 | Stanojevic | 323/303 |
| 4,926,109 | | 5/1990 | Koterasawa | 323/274 |
| 4,928,056 | | 5/1990 | Pease | 323/314 |
| 5,126,653 | * | 6/1992 | Ganesan et al. | 323/313 |
| 5,168,209 | | 12/1992 | Thiel | 323/313 |
| 5,191,278 | | 3/1993 | Carpenter | 323/275 |
| 5,274,323 | | 12/1993 | Dobkin et al. | 323/280 |
| 5,291,122 | | 3/1994 | Audy | 323/313 |
| 5,325,045 | | 6/1994 | Sundby | 323/313 |
| 5,334,928 | | 8/1994 | Dobkin et al. | 323/280 |
| 5,352,973 | | 10/1994 | Audy | 323/313 |
| 5,391,980 | | 2/1995 | Thiel et al. | 323/314 |
| 5,410,241 | | 4/1995 | Cecil | 323/315 |
| 5,485,109 | | 1/1996 | Dobkin et al. | 327/77 |
| 5,510,697 | | 4/1996 | Dormer | 323/273 |
| 5,519,308 | | 5/1996 | Gilbert et al. | 323/316 |
| 5,563,504 | | 10/1996 | Gilbert et al. | 323/316 |
| 5,629,609 | | 5/1997 | Nguyen et al. | 323/269 |
| 5,631,598 | | 5/1997 | Miranda et al. | 327/540 |
| 5,672,959 | | 9/1997 | Der | 323/273 |
| 5,675,241 | | 10/1997 | Teggatz et al. | 323/282 |
| 5,677,558 | | 10/1997 | McGlinchey | 257/370 |
| 5,686,821 | | 11/1997 | Brokaw | 323/273 |
| 5,705,919 | | 1/1998 | Wilcox | 323/282 |
| 5,736,843 | | 4/1998 | Amin | 323/273 |
| 5,814,979 | | 9/1998 | Grimm | 323/284 |
| 5,831,474 | * | 11/1998 | Thiel et al. | 323/315 |
| 5,867,015 | | 2/1999 | Corsi et al. | 323/316 |
| 6,060,874 | * | 5/2000 | Doorenbos | 323/316 |

OTHER PUBLICATIONS

Palmer, Carl R. and Dobkin, Robert C., "A Curvature Corrected Micropower Voltage Reference," Session VI: Data Acquisition Circuits, *ISSCC 81*, pp. 58–59, Feb. 18, 1981.

Frederiksen, Thomas M., "Intuitive IC OP Amps," From-BAsics to Useful Applications, *National's Semiconductor Technology Series,* pp. 8–12, 1984, No Month.

"IC Preamplifier Challenges Choppers on Drift," *National Semiconductor,* Application Notes 79–81, pp. 279–281, No Date.

* cited by examiner

| COMPONENT | VALUES AND UNITS |
|---|---|
| R1 | 122.5 kΩ |
| R2 | 127.5 kΩ |
| R3 | 112.5 kΩ |
| R4 | 75 kΩ |
| R5 | 75 kΩ |
| R6 | 12.8 kΩ |
| R7 | 28.4 kΩ |
| I1 | 2 μA |
| I2 | 1 μA |
| I3 | 2.5 μA |
| I4 | 2.5 μA |
| I5 | 4 μA |
| Q1 | emitter area = 2.6μm x 2.6μm x 2 |
| Q2 | emitter area = 2.6μm x 2.6μm x 2 |
| Q3 | emitter area = 2.6μm x 2.6μm x 8 |
| Q4 | emitter area = 2.6μm x 2.6μm x 8 |
| Q5A | emitter area = 2.6μm x 2.6μm x 2 |
| Q5B | emitter area = 2.6μm x 2.6μm x 2 |
| Q6 | emitter area = 2.6μm x 2.6μm x 5 |
| Q7 | emitter area = 2.6μm x 2.6μm x 44 |
| M1 | conduction factor = 90 μA/V^2, W=5μm, L=20μm |
| M2 | conduction factor = 90 μA/V^2, W=85μm, L=20μm |
| M3 | conduction factor = 30 μA/V^2, W=80μm, L=2μm |
| M4 | conduction factor = 30 μA/V^2, W=80μm, L=2μm |
| M5 | conduction factor = 30 μA/V^2, W=80μm, L=1μm |
| M6 | conduction factor = 30 μA/V^2, W=80μm, L=1μm |
| M7 | conduction factor = 90 μA/V^2, W=40μm, L=1μm |
| M8 | conduction factor = 90 μA/V^2, W=40μm, L=1μm |
| M9 | conduction factor = 90 μA/V^2, W=40μm, L=1μm |
| M10 | conduction factor = 90 μA/V^2, W=40μm, L=1μm |
| M11 | conduction factor = 30 μA/V^2, W=2100μm, L=1μm |

FIG. 2(c)

CM OS VOLTAGE REFERENCE WITH A NULLING AMPLIFIER

The present invention is related to U.S. patent application Ser. No. 09/416,896, entitled "SLOPE AND LEVEL TRIM DAC FOR VOLTAGE REFERENCE", filed Oct. 13, 1999; U.S. patent application Ser. No. 09/416,897, entitled "CMOS VOLTAGE REFERENCE WITH POST-ASSEMBLY CURVATURE TRIM", filed Oct. 13, 1999; and U.S. patent application Ser. No. 09/416,898, entitled "LOW DROPOUT VOLTAGE REFERENCE", filed Oct. 13, 1999; all applications are commonly assigned to the assignee of the present invention, and the disclosures of which are herein incorporated by reference.

BACKGROUND OF THE INVENTION

1. Field of the Invention

The present invention relates generally to the field of CMOS voltage references, and more particularly to a CMOS voltage reference having offset nullification.

2. Description of the Related Art

Use of a CMOS process to make a voltage reference can have advantages in cost over a precision-trimmed bipolar process. Problems with the accuracy and stability of CMOS devices must be overcome, however, in order to make a CMOS reference competitive in performance with bipolar references. Specifically, prior art CMOS voltage reference circuits suffer from the following deficiencies:

1) Lack of precision bipolar transistors in which the collector is available. Standard CMOS processes have only substrate PNPs and lateral PNPs. Substrate PNPs have collectors that go only to ground, and have very poor beta values (typically 15). Lateral PNPs have large and unstable offset voltages.
2) Lack of high-value stable and trimmable resistors.
3) Large offsets and low-frequency noise in MOS differential pairs.
4) Limited gain of CMOS amplifier stages.
5) Noise transients from switched-capacitor circuits intended to overcome the limited precision of CMOS devices.
6) Resistance of MOS switches, particularly at low supply voltages, requiring excessively large devices to avoid voltage dependent errors in the final output.
7) Uncorrectable errors in real circuits that do not appear in simulations, making circuit design difficult.
8) Excessive manufacturing complexity which raises the cost.

One of the biggest challenges in designing a precision CMOS voltage reference is overcoming the errors arising from circuitry outside the band-gap core. Unlike the core variations, which tend to be smooth and stable, the outside errors show erratic variations with time and temperature, and cannot be trimmed out. A common technique to avoid the errors arising from mismatches in MOS transistors, for example, uses switched capacitors to sample the offset at the input to a MOS amplifier and subtract it from the signal. Such a technique is disclosed in U.S. Pat. No. 4,190,805, entitled "COMMUTATING AUTOZERO AMPLIFIER" by Bingham. This "autozero" technique is not suitable for precision CMOS voltage references, however, due to the switching transients produced. These transients are too large even with the most careful matching of switches and clock waveforms.

There are many variations on these "autozero" techniques, but every circuit that has switches near the signal path produces transients at the output that are too large for a CMOS voltage reference that must compete with bipolar circuits. The same problem occurs in voltage reference circuits that use switched capacitors in place of precision core resistors, such as the circuit disclosed in U.S. Pat. No. 5,563,504 entitled "SWITCHING BANDGAP VOLTAGE REFERENCE."

Thus, there is a need to provide a technique for reducing the untrimmable instabilities in the output voltage of a CMOS voltage reference, without introducing other problems, such as switch transients in the output voltage.

SUMMARY OF THE INVENTION

The present invention is a CMOS voltage reference comprising a band-gap core, a primary amplifier and a "nulling" amplifier. An auto-zeroed nulling amplifier is placed outside of the signal path of the primary amplifier, and is used to null the offsets and noise associated with the primary amplifier. The nulling amplifier integrates the offset seen at the input of the primary amplifier, and applies a correction signal to adjust the offset to zero. This correction signal is used for only a relatively slow adjustment of the offset of the primary amplifier. Whatever switch transients occur in the nulling amplifier are effectively filtered out by the long integration time of the nulling amplifier.

The voltage reference may also include slope, level and curvature trim circuits to provide a low-cost CMOS voltage reference that can be trimmed after final packaging. Due to the nulling of the errors elsewhere in the circuit, the trim circuits are able to adjust the variations solely from the band-gap core. Thus, the nulling amplifier facilitates the trimming scheme as well.

Unique elements of the present circuit include independent adjustment of level, slope, and curvature in the voltage vs. temperature characteristic, use of a nulling amplifier to make the temperature characteristic smooth and stable, using on-chip non-volatile memory, and unique circuit techniques to accomplish the trim adjustments while maintaining a high level of precision and stability. Because these adjustments are made by programming a non-volatile memory after final assembly, this circuit does not suffer from the post-trim assembly shifts that often limit the accuracy of bipolar references. The present invention also uses a novel current replication technique in the slope and level trim DACs, and at least one non-linear resistor with optimal curvature to correct high-order curvature in the output.

BRIEF DESCRIPTION OF THE DRAWINGS

The present invention will be readily understood by the following detailed description in conjunction with the accompanying drawings, wherein the structural elements in each schematic are not necessarily related to other similarly named elements in other schematics, and in which:

FIG. 2(C) is a table of component values for the components in FIG. 2(B);

DETAILED DESCRIPTION OF THE INVENTION

The following description is provided to enable any person skilled in the art to make and use the invention and sets forth the best modes contemplated by the inventor for carrying out the invention. Various modifications, however, will remain readily apparent to those skilled in the art, since the basic principles of the present invention have been defined herein specifically to provide a CMOS voltage reference incorporating a nulling amplifier. Also, unless stated otherwise, the components in each schematic are not necessarily related to other similarly labeled components in other schematics.

Figure 1:
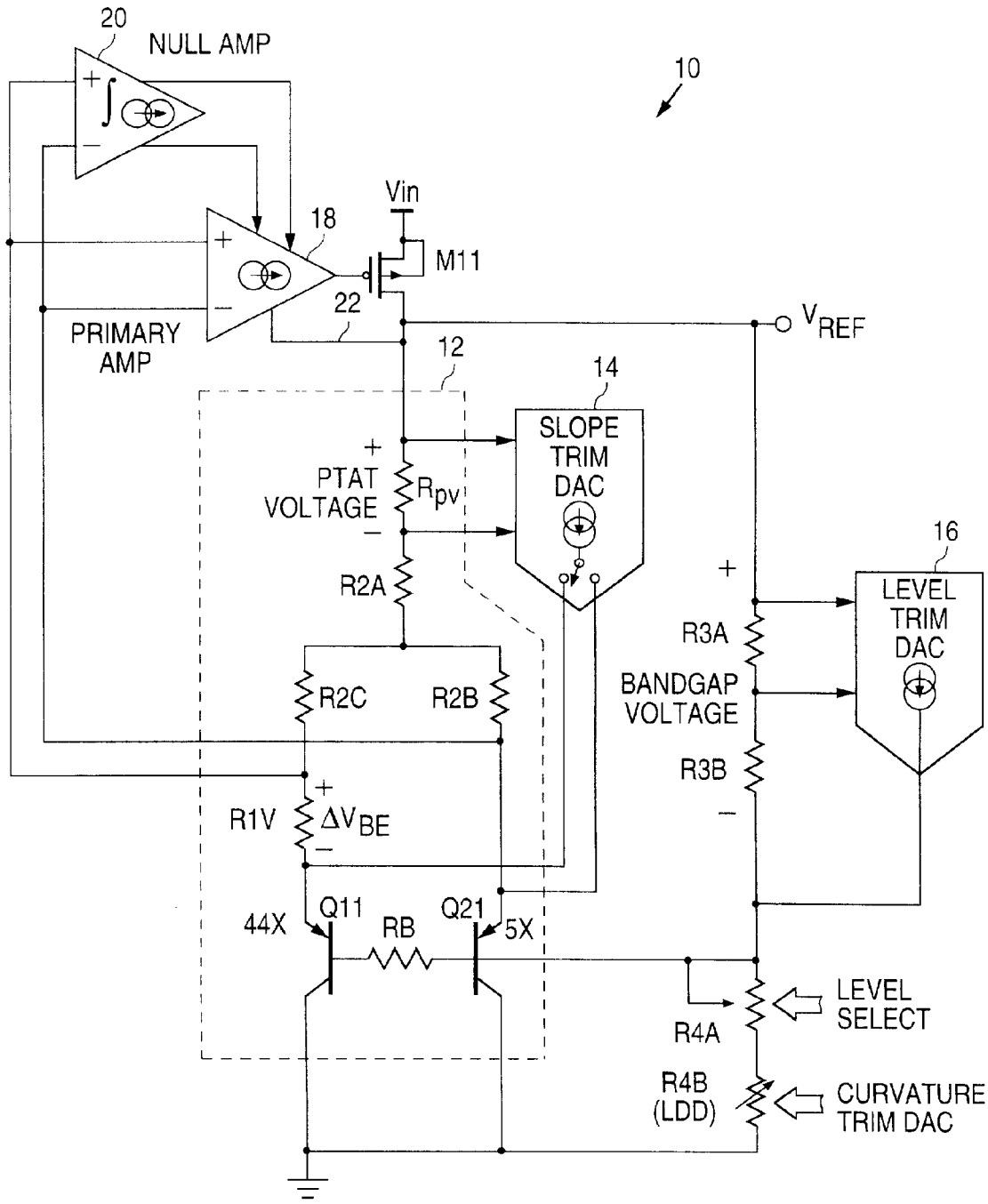
FIG. 1 is a block diagram of a low dropout voltage reference according to the present invention, having offset nullification and incorporating slope, level and curvature trim.

FIG. 1 is a high-level block diagram illustrating a CMOS low dropout voltage reference incorporating the present invention. The voltage reference comprises a band-gap core 12, connected to a primary amplifier 18, an output FET M11, and a null amplifier 20. The circuit further comprises a slope trim DAC 14 and a level trim DAC 16 for adjusting the slope and level of the output $V_{REF}$. A level select R4A selects one of the available output voltage options, for example, the circuit can be designed to output three different $V_{REF}$ values. Finally, the curvature trim DAC R4B is shown as a potentiometer to illustrate that it has a variable resistance, but it actually consists of a network of non-linear resistors that can be controlled by setting a non-volatile memory. In fact, the slope, level and curvature trims can be performed after final packaging via the non-volatile memory. The CMOS voltage reference of FIG. 1 provides a precision voltage reference that can be manufactured in a standard CMOS process and trimmed after final assembly.

The band-gap core 12 comprises a pair of bipolar transistors Q11, Q21 which generate a voltage proportional to absolute temperature (PTAT). A network of resistors connected to these transistors Q11,Q21 are arranged to multiply the PTAT voltage and add it to the base-emitter voltage of one of the transistors so that the total voltage is constant over temperature.

The band-gap core 12 thus provides a temperature compensated reference, allowing the present invention to operate over a wide temperature range.

Figure 2A:
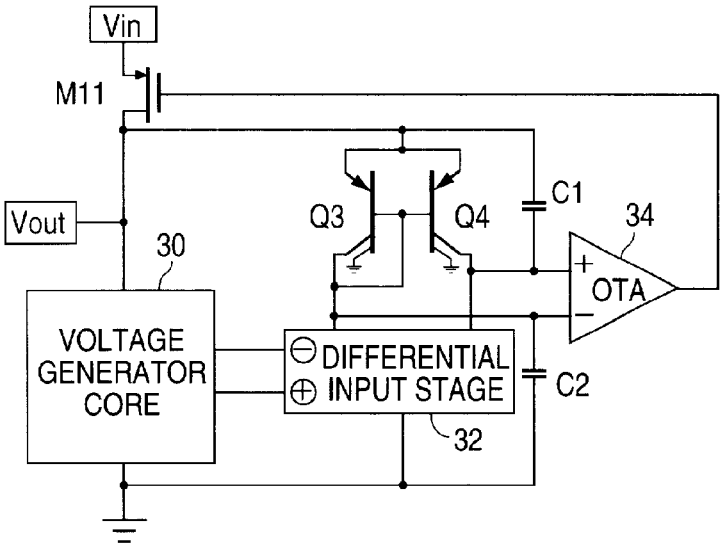
FIG. 2(A) is a block diagram of a primary amplifier according to the present invention.
Figure 2B:
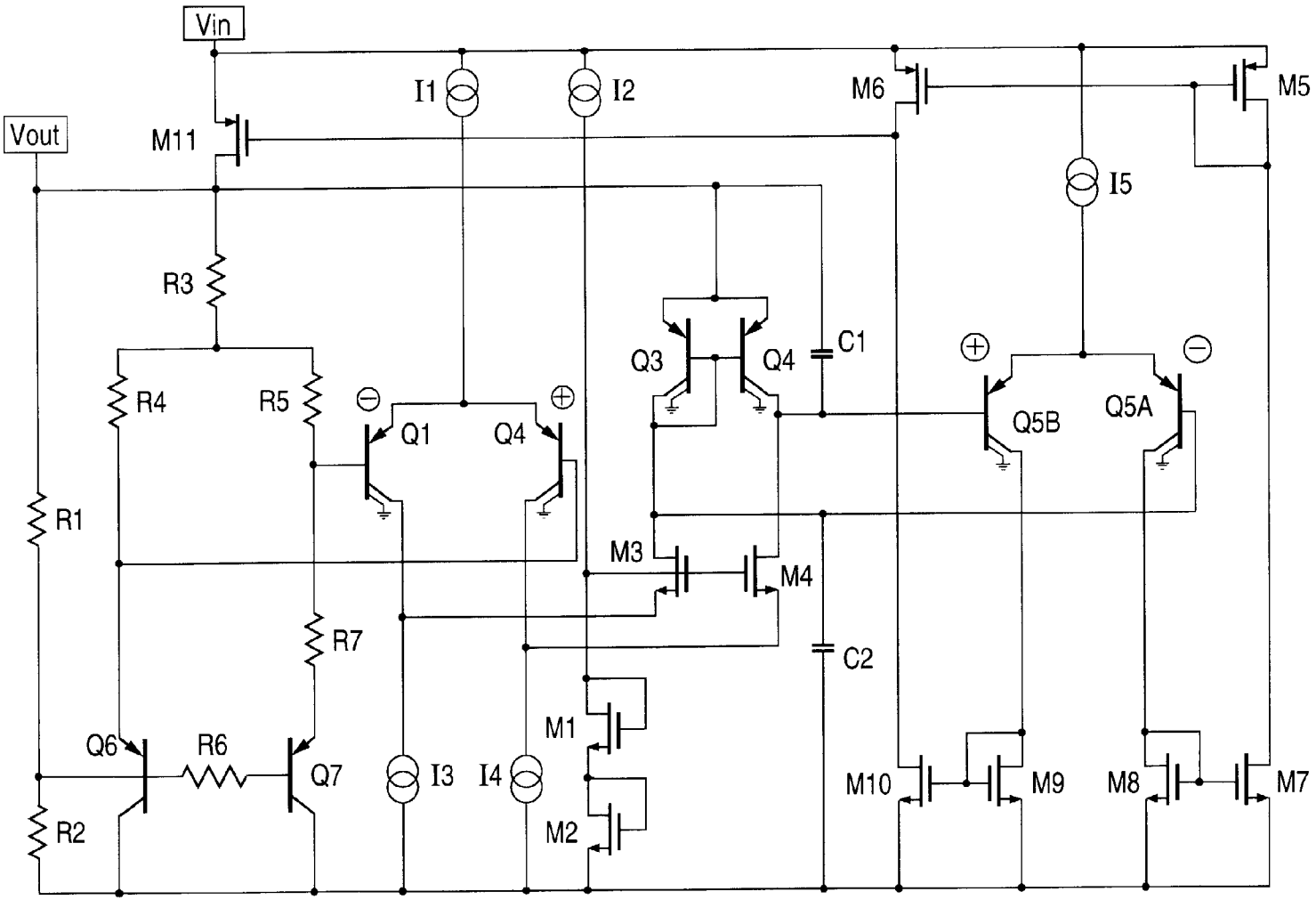
FIG. 2(B) is a schematic of an embodiment of the primary amplifier according to the present invention.

The primary amplifier 18 may be constructed as shown in FIGS. 2(A)–2(C), and disclosed in detail in related U.S. application Ser. No. 09/416,898, entitled "LOW DROPOUT VOLTAGE REFERENCE", filed Oct. 13, 1999. In general, the primary amplifier 18 is a low dropout (LDO) amplifier with two feedback loops, an overall loop (through the differential input stage 32, differential amplifier 34, to the output FET M11) and a secondary loop (Vout, through the current mirror of Q3, Q4 to the differential inputs of the amplifier 34, through the amplifier 34, to the controlling terminal of the output FET M11, and then through the output FET M11 and back to the output). The overall feedback loop establishes a desired output voltage. The secondary feedback loop provides two benefits: (1) a broadband reduction of the output impedance to ensure stability under various loading conditions and (2) an improvement in power supply rejection.

The LDO amplifier of FIG. 2(A) consists of three gain stages, a differential input stage 32, a second gain stage 34, and a PMOS FET M11 output device. The LDO amplifier has a secondary feedback loop where the forward propagating signal passes through the second gain stage 34, through the PMOS output M11 and is fed back to the second gain stage 34 through the current mirror Q3, Q4. This internal secondary feedback loop provides two benefits: (1) the open loop output impedance of the LDO amplifier is lowered by the loop gain of the internal feedback loop and (2) the voltages at the output terminals of the current mirror Q3, Q4 are forced to be essentially equal. The first benefit ensures that the pole created by the load capacitance and the output impedance of the amplifier doesn't adversely affect the overall loop stability. The second benefit helps improve line regulation.

Thus, the present invention does not rely on a capacitor connected to the output to properly compensate the overall feedback loop. Therefore, the reference will work properly for a wide range of load capacitance values.

FIG. 2 (B) shows a simplified circuit diagram of the disclosed invention. Table 2(C) shows typical component values for the components of FIG. 2(B) suitable for use with the present invention. Note that the component values are provided for purposes of illustration and that common parts and their equivalents may be substituted without departing from the scope of the present invention. The primary amplifier block 18, includes the circuitry of FIG. 2(B), excluding the output FET M11, and the band-gap core comprising Q6 and Q7, and the related resistors (R1–R6). These components have been reproduced separately in FIG. 1 for clarity, with the band-gap core 12 formed by Q11 and Q21. The feedback line 22 on the primary amplifier 18 corresponds to the line connecting the node formed by Q3, Q4 and C1 in FIG. 2(B), with the drain of output FET M11. The output of the primary amplifier 18 corresponds to the line connecting the drain of M6 with the gate of the output FET M11 in FIG. 2(B).

The ideal way to trim the slope and level of the reference 10 would be to adjust the values of R1V and R4A directly (FIG. 1). However, simply adjusting a potentiometer to change the voltage up or down is not practical for CMOS wafer design. A voltage reference circuit could be trimmed by using analog switches in series with either resistors or shunt resistors. Switches in series with resistors, though, would cause problems due to the variations in the switch resistance that could not be trimmed out. Also, the resistor values could be modified by using a laser to etch thin-film resistors during a calibration procedure. However, this procedure can not be used after the device has already been packaged.

The present solution solves the trimming problem by injecting a current into a node, thereby changing the magnitude of the current and the associated voltage $V_{REF}$. In other words, injecting a current has the same effect as modifying the resistor values. However, not just any injected current with any temperature coefficient (TC) will work. Since the TC of the injected current would ultimately affect the TC of $V_{REF}$, the injected current needs to have a TC that tracks the TC of the current already flowing in the voltage reference circuit (i.e. the current flowing through R3A).

Accordingly, the level and slope trimming is accomplished using current-switching DACs 14, 16 to inject small correction currents into the voltage reference circuit. Each DAC is controlled via a programmable non-volatile memory, such as an EEPROM. Since, the EEPROM can be programmed after final packaging, the present invention provides a technique to trim the voltage reference devices after the circuit has been packaged. As shown in FIG. 1, for the slope trim, the current is injected into one side or the other of the band-gap core cell. The level trim DAC 16 injects a correction current and into the resistor chain that sets the voltage level at the base of the transistors Q11, Q21 in the band-gap core 12.

The level and slope trim DACs 14, 16 generate currents that are precise multiples of the currents through the resistors being trimmed. Thus the corrections are invariant with process and temperature, the necessary trim range is minimized, and the shape of the remaining error (curvature) is not altered. This current replication technique has the same effect as an ideal trim, i.e. produces the same result as changing the values of the resistors around which the trim circuits are placed.

Figure 10:
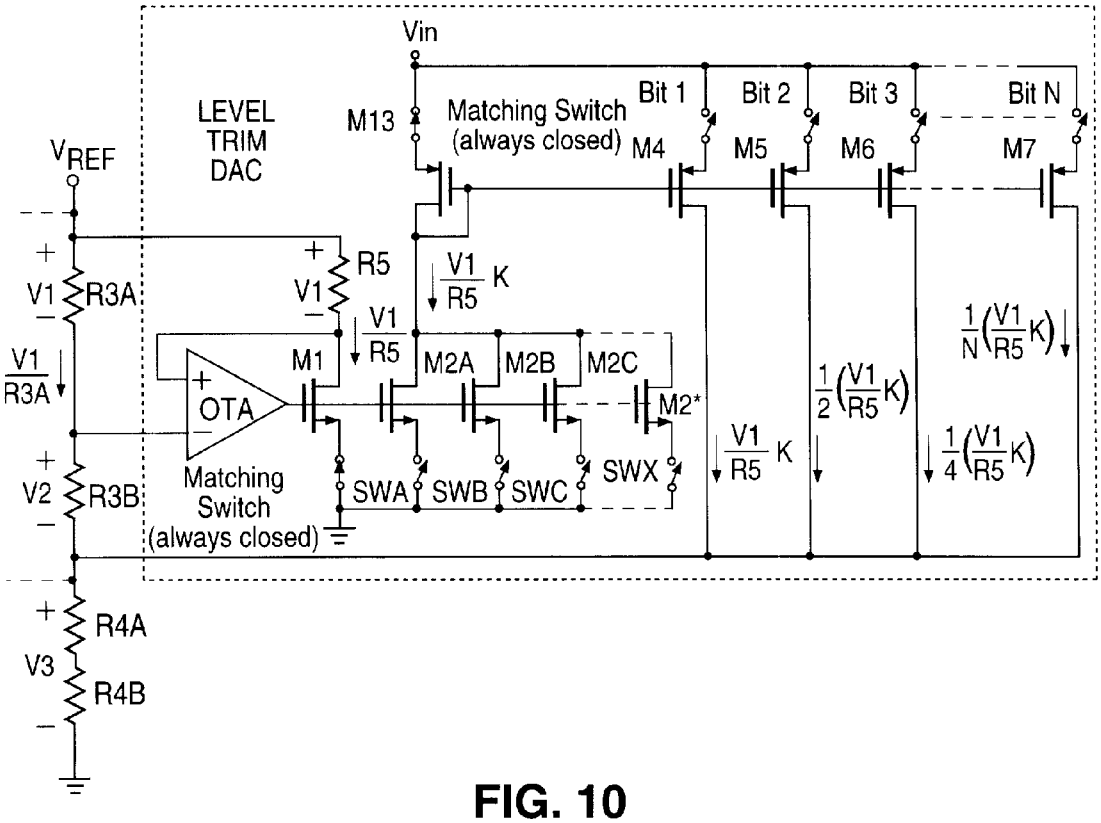
FIG. 10 is a schematic of an embodiment of the level and slope trim DACs according to the present invention.

The circuit operation will now be described with reference to FIG. 10. The voltage V1 across R3A is replicated across R5 by the feedback action of the output transconductance amplifier (OTA) and transistor Mt. This creates a current in M1 ($I_{M1}=V_1/R_5$) that is mirrored by M2. M2 comprises a selectable set of current mirrors M2A–M2*, which can multiply the current mirrored by M1. M2 supplies a reference current to the controlling diode, M3, of the current output DAC consisting of M3 through M7. The output of the current DAC is fed back to the node between R3B and R4A. The resulting expression for the output voltage of the reference is:

$$V_{REF} = V_1\left(1 + \frac{R_{3B}}{R_{3A}}\right) + V_1\left(\frac{1}{R_{3A}} + \frac{K * Bit1}{R_5} + \frac{K * Bit2}{2R_5} + \frac{K * Bit3}{4R_5} + \ldots + \frac{K * BitN}{2^{N-1}R_5}\right)(R_{4A} + R_{4B})$$

where Bit*=1 or 0, and K is a function of the relative channel width to length ratios of M1 to M2, and the state of the switches SW*.

As seen from the equations above, changing the code of the DAC (i.e. selecting an appropriate combination of FETs) has the same effect as changing the value of R4A. Specifically, using the present invention, the resistor ratio multiplying V1 is adjusted. Also note that the injected current has a TC that tracks the TC of the current flowing through R3A. The switches used to control the FETs in the current mirrors are located outside of the main voltage reference circuit, and therefore do not cause the same problems associated with switching in resistors in the main circuit. As shown here, the DAC only injects current. However, the DAC can be designed to only sink current, or both source and sink current as disclosed in U.S. patent application No. 09/416,896, entitled "SLOPE AND LEVEL TRIM DAC FOR VOLTAGE REFERENCE", filed Oct. 13, 1999.

The same DAC can be used for all voltage reference level options by simply selecting the appropriate reference current (K*(V1/R5)) via M2 and its multipliers. Thus, the present invention provides a "selectable trim" providing different trimming steps, depending upon a desired output reference voltage level. For example, if the voltage reference has three different output levels, ideally the scaling factor would provide the same percentage step of the total $V_{REF}$ for each level. This can be accomplished by selecting the appropriate ratio of M1 to M2, via the M2 switches. If only one voltage level is needed, M2 can comprise a single FET to mirror the current at a fixed ratio. Finally, the DAC code can be programmed after the voltage reference has been packaged, during a final calibration procedure, thus providing a post assembly level trim.

The slope trim DAC 14 circuit operates exactly as the level trim DAC 16 discussed above with reference to FIG. 10. As shown in FIG. 1, the slope is adjusted by taking a current that has similar TC characteristics to the current flowing in resistor Rpv, replicating the current in the slope trim DAC 14, and then injecting the correction current into one side or the other of the band-gap core 12, i.e. either the emitter of Q11 or the emitter of Q21. The output of the slope trim DAC 14 is selectable to allow the slope to be adjusted either up or down. The injected current changes the magnitude of the delta Vbe term in the band-gap 12 and thereby changes the slope of the output voltage $V_{REF}$.

Figure 11:
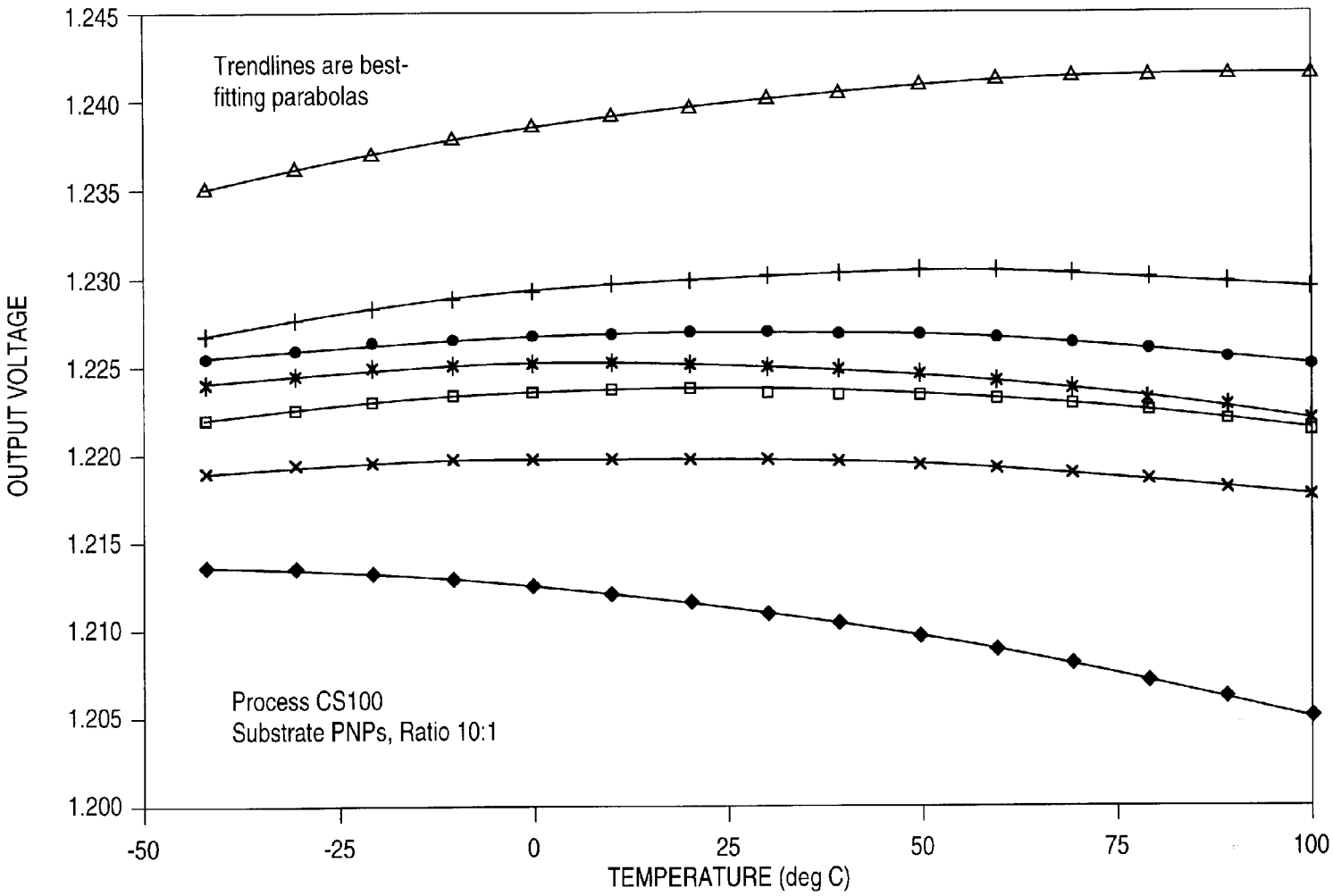
FIG. 11 is a graph of output voltage vs. temperature for actual data from untrimmed band-gap cores.
Figure 12:
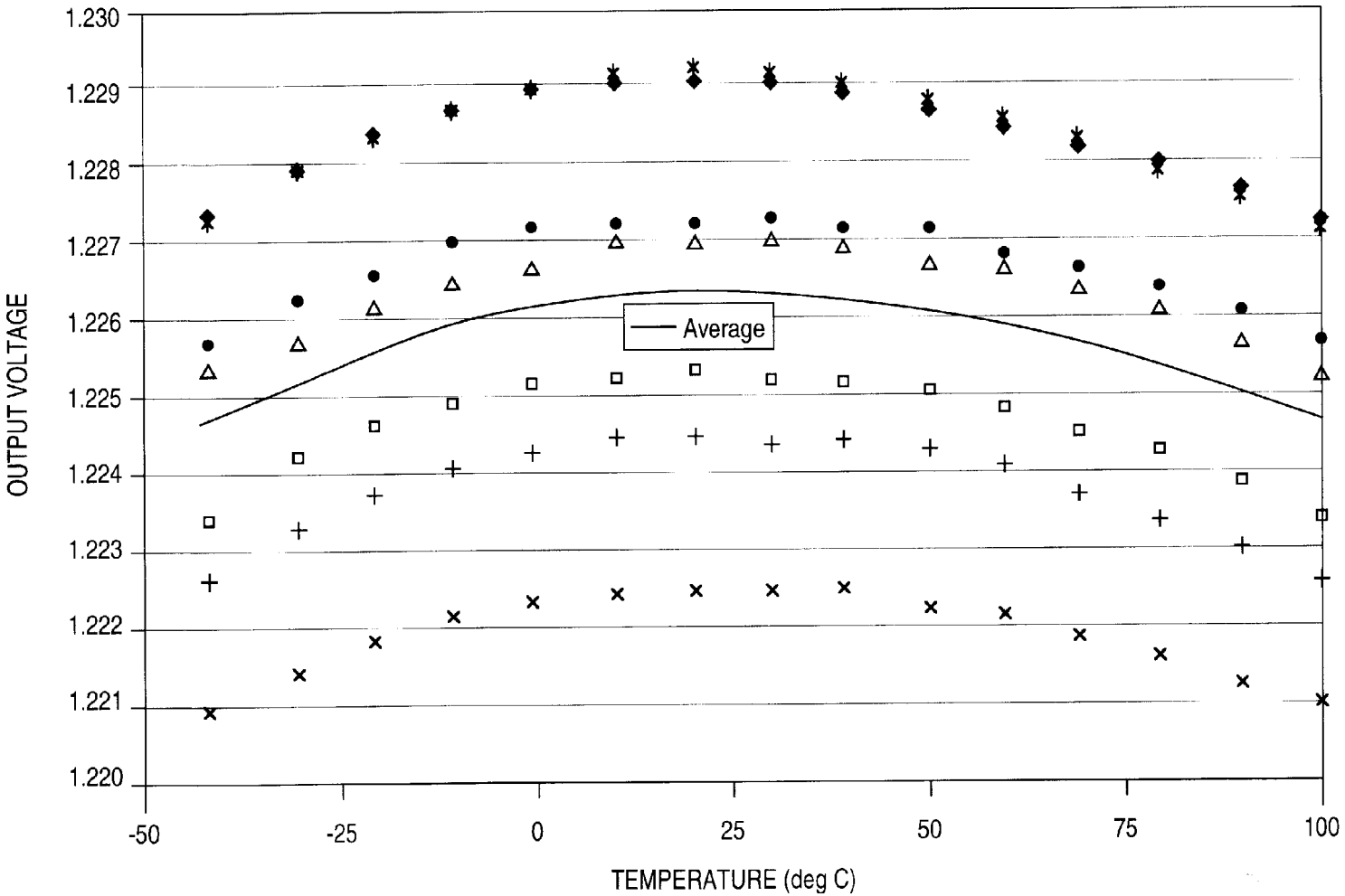
FIG. 12 is a graph of the data of FIG. 11, after the slope has been trimmed.
Figure 13:
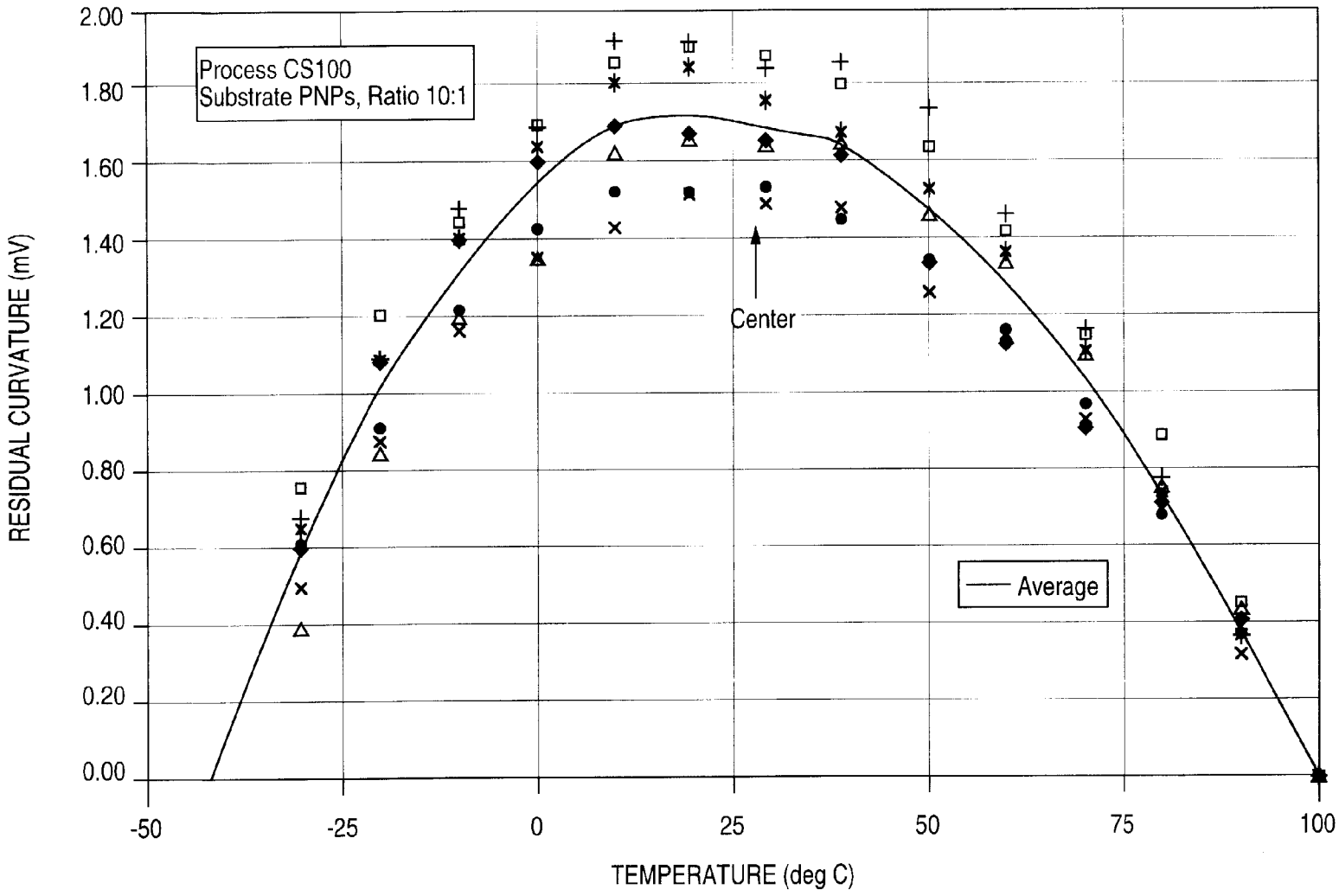
FIG. 13 is a graph of the data of FIG. 11, after both the slope and level have been trimmed.

FIG. 11 is graph of the output voltage of the band-gap core of FIG. 1 before any trim is performed. FIG. 12 shows the results after the slope has been trimmed, and FIG. 13 shows the remaining curvature error after both the slope and level have been trimmed.

Figure 14:
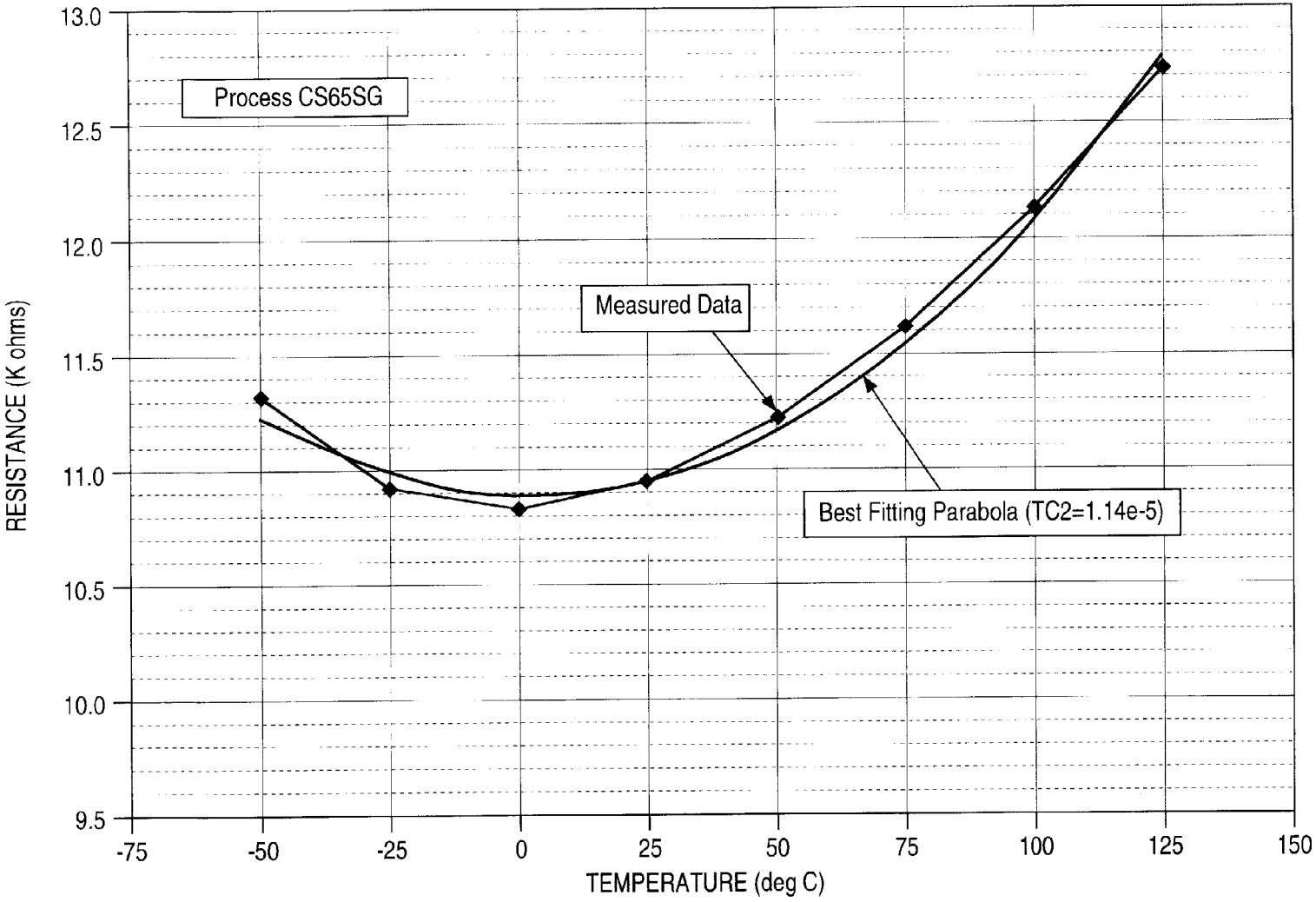
FIG. 14 is a graph of the resistance vs. temperature for a diffused resistor used to trim the curvature according to the present invention.
Figure 15:
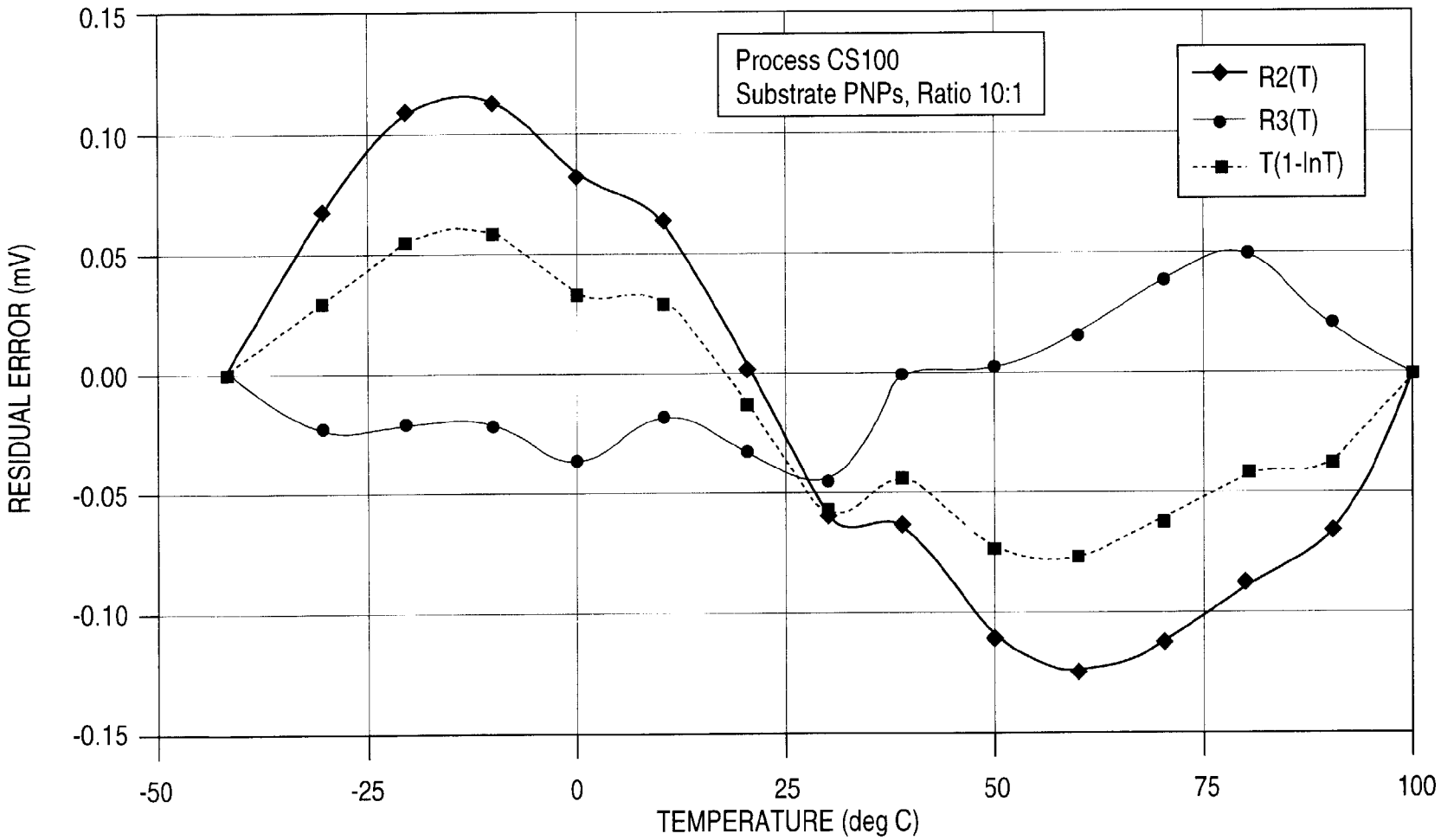
FIG. 15 is a graph of the data of FIG. 13, showing the differences between the experimental data and various correction curves.

The curvature trim may be performed via R4B using at least one non-linear resistor as disclosed in U.S. patent application Ser. No. 09/416,897, entitled "CMOS VOLTAGE REFERENCE WITH POST-ASSEMBLY CURVATURE TRIM", filed Oct. 13, 1999. The curvature trim DAC R4B is shown as a potentiometer to illustrate that it has a variable resistance, but it actually consists of a network of non-linear resistors that can be controlled by setting a non-volatile memory. Specifically, at least one resistor that is non-linear over temperature is used to compensate the negative curvature error associated with the band-core 12. For example, FIG. 14 shows the resistance characteristics of a diffused lightly-doped drain (LDD) resistor that can be used to compensate the curvature error of FIG. 13. FIG. 15 shows the averaged data of FIG. 13 after application of various curvature correction schemes. R2(T) is an ideal parabolic corrector, R3(T) is the third-order correction generated by the non-linear resistor network of the present invention. The T(1−1nT) curve is the theoretical ideal correction curve.

As described so far, the CMOS voltage reference 10 would still suffer from offsets and noise associated with the primary amplifier 18 and line and load regulation problems caused by the output FET M11. In order to overcome these problems, the present invention uses a variation on the known "chopper stabilization" technique used in precision operational amplifiers. An auto-zeroed "nulling amplifier" 20 is placed outside of the primary signal path and is used to null the errors associated with the aforementioned problems. The nulling amplifier 20 integrates the signal seen at the output of the band-gap core 12, and applies a correction signal elsewhere in the primary loop to force a null at the band-gap core. The correction signal produced by the nulling amplifier 20 is used for only a relatively slow adjustment of the offset of the primary amplifier 18. Whatever switch transients occur in the nulling amplifier 20 are effectively filtered out by the long integration time of the nulling amplifier 20.

In one embodiment, the correction signal is a differential current injected into the input stage of the primary amplifier 18. The injected current is used to deliberately produce an offset in the primary amplifier 18. At equilibrium, this offset cancels all of the errors produced by circuitry outside of the band-gap core 12. By forcing a null at the output of the band-gap core 12, the input to the core ($V_{REF}$) only contains errors arising from the core components. These components (substrate PNP transistors and polysilicon resistors) are among the most stable available in common CMOS processes. The resulting smooth and stable temperature characteristic is easily trimmed by the methods described above.

The primary amplifier 18 can be optimized for fast continuous response, while the nulling amplifier 20 is optimized for low-offset. Because the nulling amplifier 20 is not required to be fast or continuous, switching and sampling techniques can be used to minimize its offset. Instability is avoided by making the nulling amplifier 20 much slower that the primary amplifier 18, thereby allowing the primary amplifier 18 to dominate the high-frequency response. Generally, the nulling amplifier 20 is still fast enough that most of the 1/f noise in the primary amplifier 18 can be nulled. Thus, unlike the circuits in the prior art discussed above, the present invention operates without any switches in the main signal path.

As discussed above, the primary amplifier 18 has no switches, and is optimized for fast response under varying loads. The nulling amplifier 20 slowly adjusts the offset of the primary amplifier 18 until the signal from the band-gap core 12 is nulled. Switching and sampling techniques are used to ensure the lowest possible offset for the nulling amplifier 20. Because the nulling amplifier 20 is slow relative to the primary amplifier 18, and the output of the primary amplifier 18 is not very sensitive to its null adjust inputs, clock noise from the nulling amplifier 20 has very little effect at the output. Nulling of the low-frequency noise is limited by the stability of the two amplifiers working together. The integrator and sample delay in the nulling amplifier will render the loop unstable unless the primary amplifier 18 is dominant at high frequencies.

Figure 3:
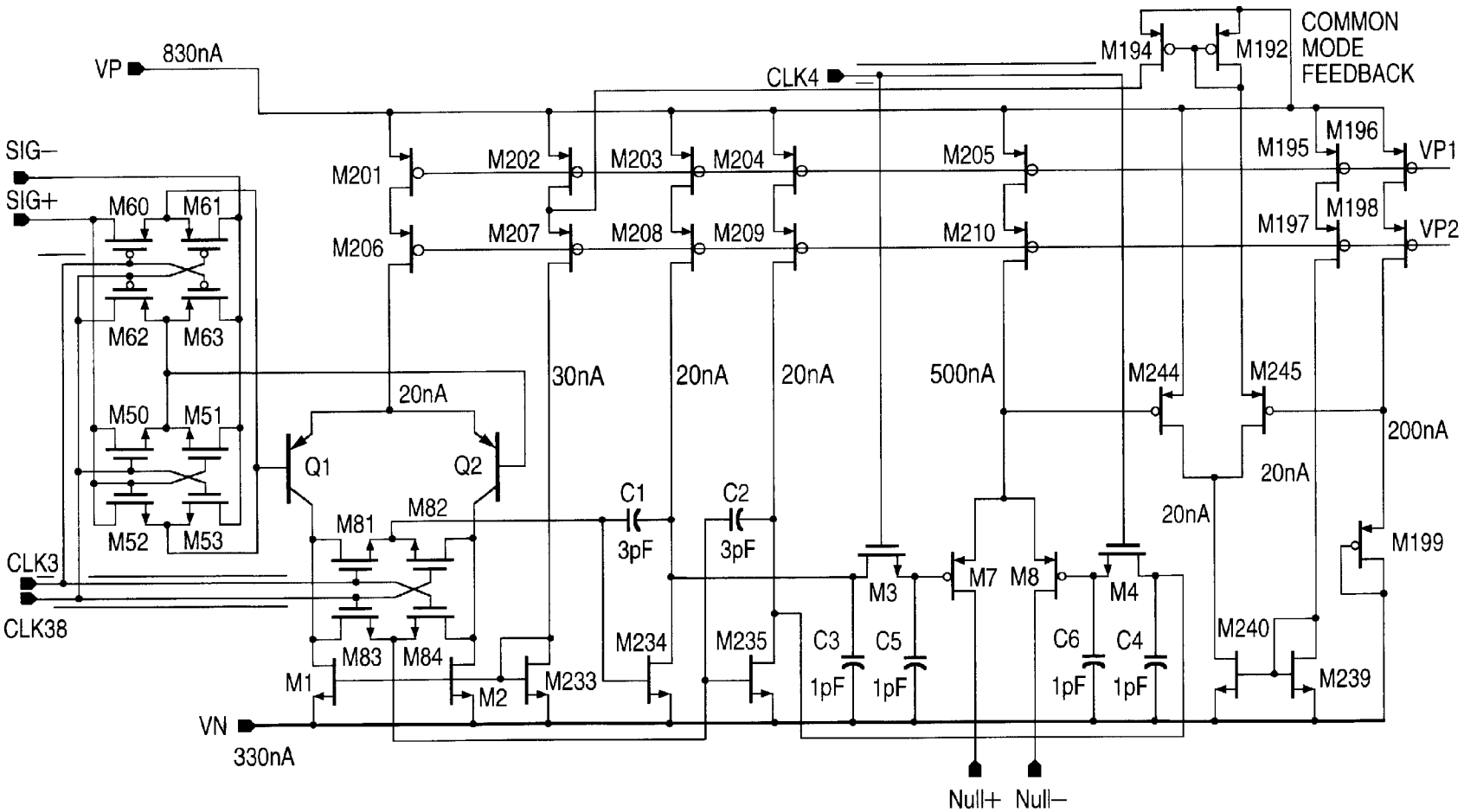
FIG. 3 is a schematic of an embodiment of the null amplifier according to the present invention.

FIG. 3 shows an embodiment of the nulling amplifier 20 constructed in a 0.72 $\mu$m CMOS process. The nulling amplifier 20 is a fully-differential three-stage integrating amplifier with sample-and-hold switches on the output stage. First-stage offsets (and 1/f noise) are nulled by switching the entire first stage (including the current sources M1–M2) with a precise 50% duty cycle CLK3. Ideally, any offsets should average to zero. The sample-and-hold switches are necessary because the internal offsets of this amplifier result in a saw-tooth waveform on the integrating capacitors C1 and C2.

A narrow sampling pulse CLK4 is timed to occur at the same part of each cycle. A saw-tooth wave with a steady average value should result in a steady DC voltage on the gates of the output transistors M7–M8. The fully differential design ensures minimum clock noise at the output.

Figure 4:
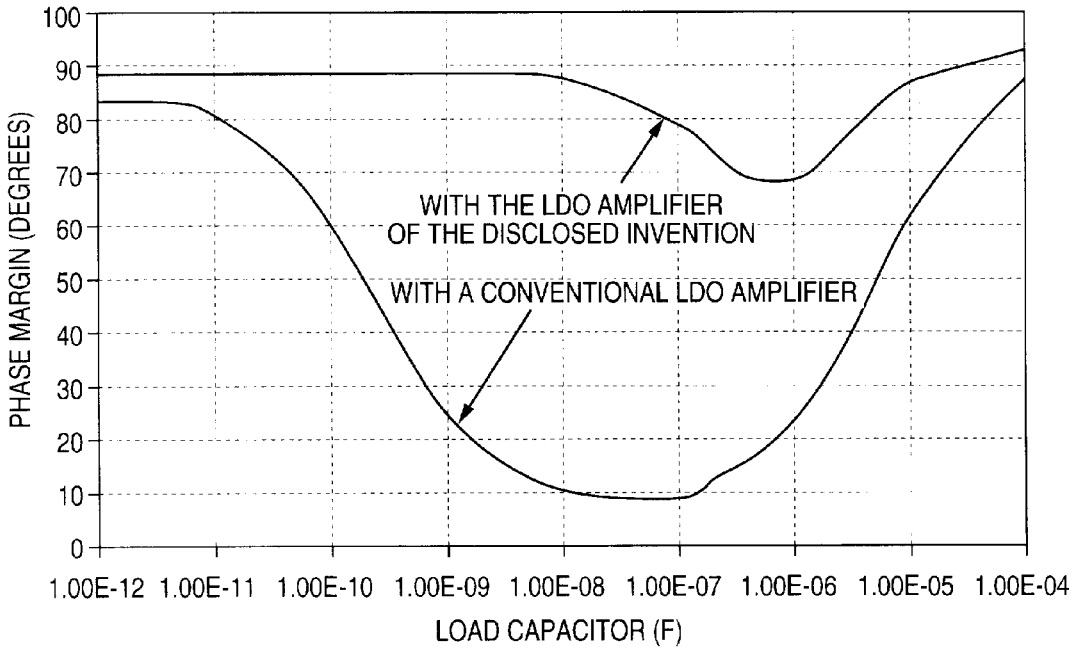
FIG. 4 is a graph of the closed loop phase margin as a function of the load capacitor, comparing the performance of a conventional low dropout amplifier and the present invention.
Figure 5:
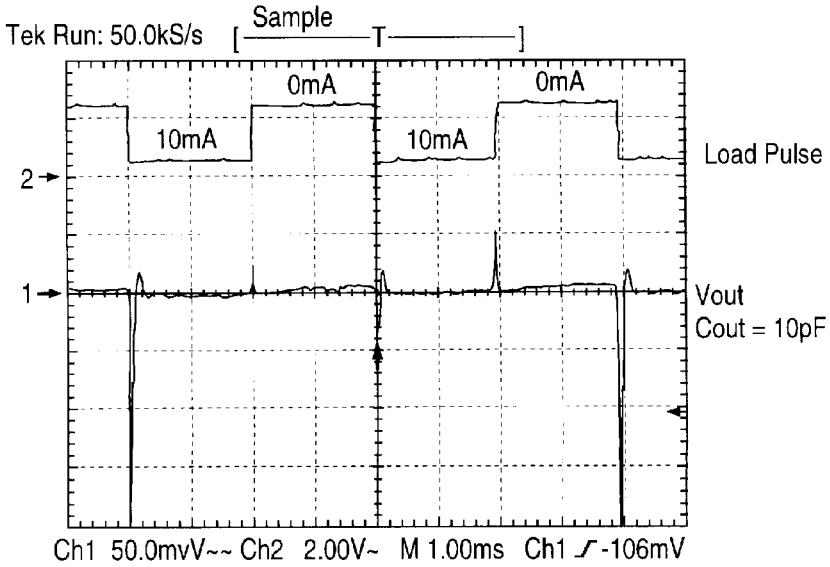
FIG. 5 is a graph showing the response of an embodiment of the present invention to a 10 mA, 1 KHz load pulse with an output capacitance of 10 pF.
Figure 6:
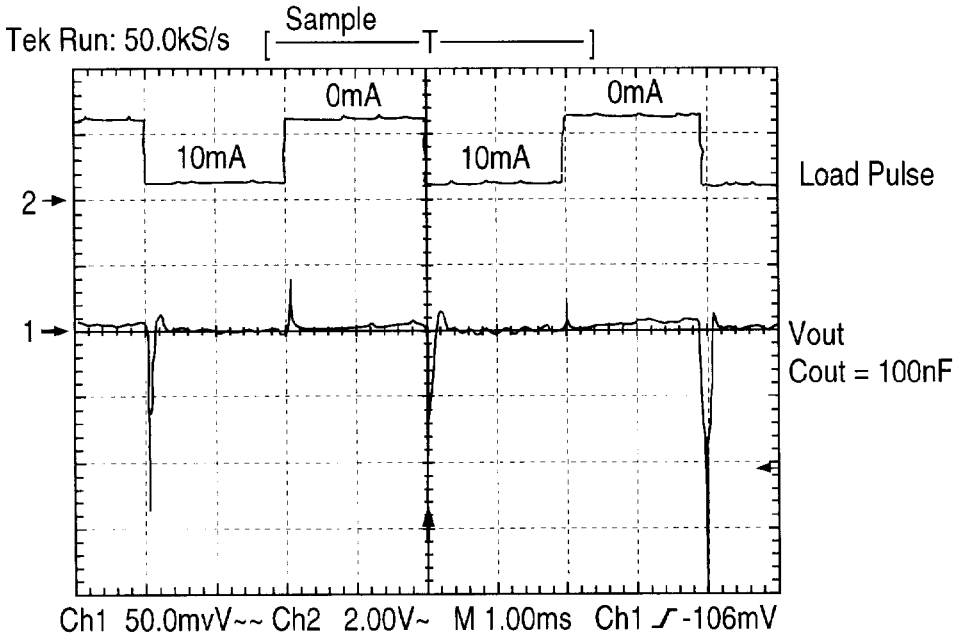
FIG. 6 is a graph showing the response of an embodiment of the present invention to a 10 mA, 1 KHz load pulse with an output capacitance of 100 nF.
Figure 7:
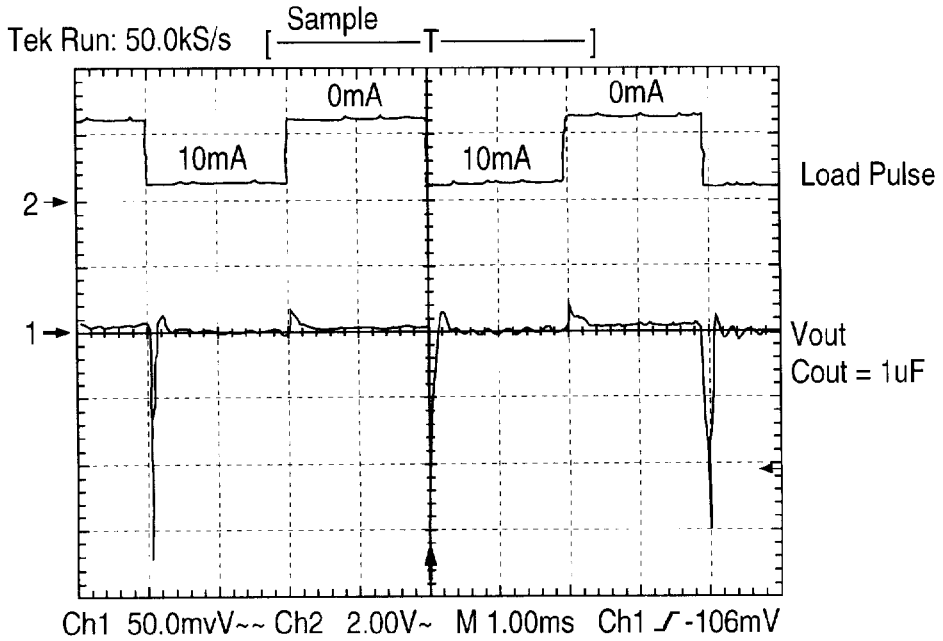
FIG. 7 is a graph showing the response of an embodiment of the present invention to a 10 mA, 1 KHz load pulse with an output capacitance of 1 $\mu$F.
Figure 8:
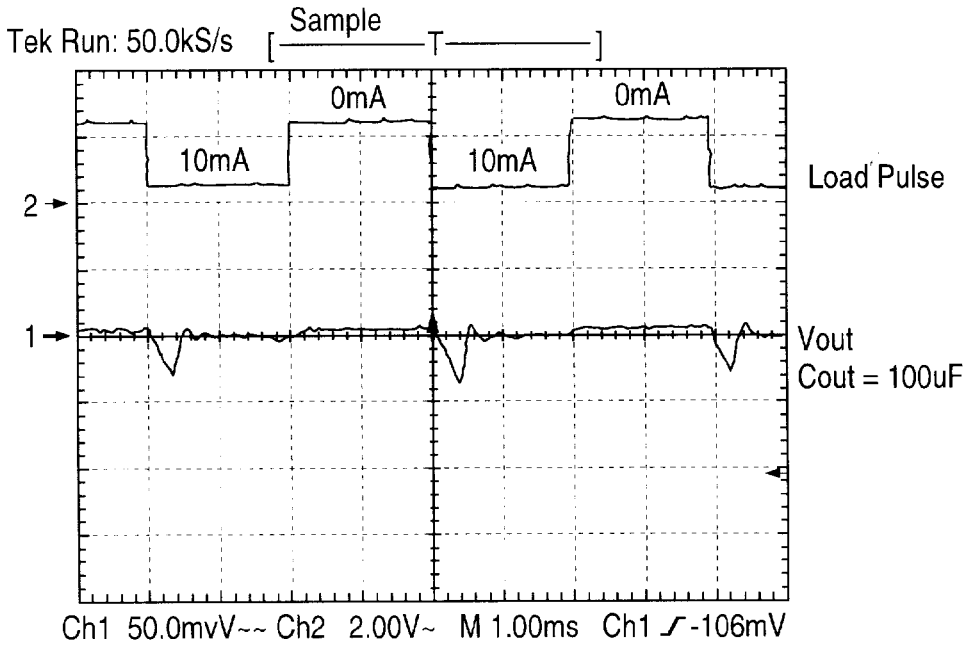
FIG. 8 is a graph showing the response of an embodiment of the present invention to a 10 mA, 1 KHz load pulse with an output capacitance of 100 $\mu$F.

FIG. 4 shows the results of computer simulations comparing the performance of the present invention (FIG. 1) to a voltage reference that uses a conventional LDO amplifier. The plot compares the stability of the reference as a function of the load capacitance. The present invention maintains adequate closed loop phase margin for any practical capacitive load. It should be noted that the load capacitor used in the simulations had no equivalent series resistance.

FIGS. 5–8 show the response of a low dropout voltage reference according to the present invention to a 10 mA, 1 kHz load pulse with ceramic output capacitor values of 10 pF, 100 nF, and 100 $\mu$F, respectively. No resistors were placed in series with the load capacitors. The figures show that the reference remains stable under these varying capacitive loading conditions. A 100 nF bypass capacitor was connected to the input pin (Vin) of the reference for these tests. When the output capacitor was less or equal to 1 $\mu$F, the output setting time was typically less than 200–300 $\mu$s.

Figure 9:
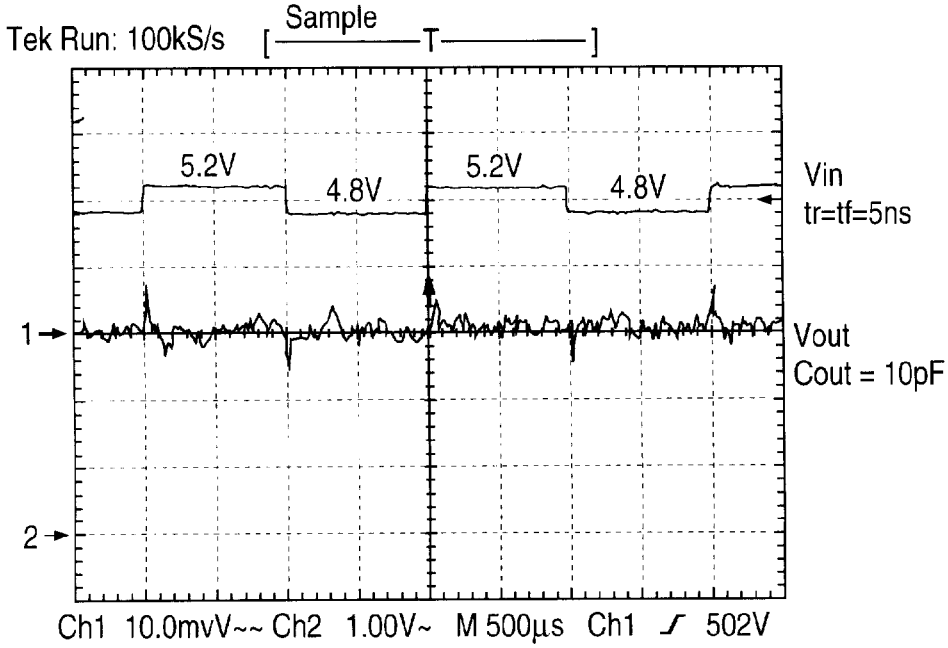
FIG. 9 is a graph showing the response of an embodiment of the present invention to a 400 mV step on the input voltage, with an output capacitance of approximately 10 pF.

FIG. 9 shows the output response of the voltage reference of the present invention to a 400 mV step on the input voltage (i.e. Vin=5V+/−0.2V). The rise and fall time of the step was 5 ns. The output capacitance was approximately 10 pF (due to the scope probe). The glitching seen at output due to the step on the input voltage is barely observable above the noise.

The present circuit is a band-gap voltage reference that can be manufactured at low cost in a standard CMOS process, using non-volatile memory (EEPROM) for trimming. Unique elements of this design include independent adjustment of level, slope, and curvature in the voltage vs. temperature characteristic, the use of on-chip non-volatile memory, and unique circuit techniques to accomplish these adjustments while maintaining a high level of precision and stability. Because these adjustments are made by programming the EEPROM after final assembly, this circuit does not suffer from the post-trim assembly shifts that often limit the accuracy of bipolar references. The present invention also uses a novel current replication technique in the slope and level trim DACs, and at least one non-linear resistor with optimal curvature to correct high-order curvature in the output. Finally, an auto-zeroed "nulling amplifier" overcomes the errors introduced by errors outside the band-gap core, and the amplifiers are configured to avoid adding switch transients to the main signal path.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A CMOS voltage reference comprising:

a band-gap core;

a primary amplifier; and an offset nulling amplifier, where in the an input of the offset nulling amplifier is electrically connected to an output of the band-zap core, wherein the offset nulling amplifier receives an output of the band-gap core and integrates a signal from the output of the band-gap core and applies a correction signal to a primary loop of the primary amplifier to force a null at the band-gap core.

2. The CMOS voltage reference of claim 1, wherein the offset nulling amplifier is outside of a signal path of the primary amplifier.

3. The CMOS voltage reference of claim 2, wherein the nulling amplifier nulls offsets and noise associated with the primary amplifier.

4. The CMOS voltage reference of claim 3, wherein the nulling amplifier integrates an offset at the input of the primary amplifier, and applies a correction signal to adjust the offset to zero.

5. The CMOS voltage reference of claim 4, wherein the correction signal is used for only a relatively slow adjustment of the offset of the primary amplifier.

6. A CMOS voltage reference comprising:

a band-gap core;

a primary amplifier; and an offset nulling amplifier, wherein the offset nulling amplifier is outside of a signal path of the primary amplifier, wherein the nulling amplifier nulls offsets and noise associated with the primary amplifier, wherein the nulling amplifier integrates an offset at the input of the primary amplifier, and applies a correction signal to adjust the offset to zero, wherein the correction signal is used for only a relatively slow adjustment of the offset of the primary amplifier, wherein the primary amplifier is optimized for a fast continuous response, and the nulling amplifier is optimized for low-offset.

7. The CMOS voltage reference of claim 6, further comprising an output FET connected to an output of the primary amplifier.

8. The CMOS voltage reference of claim 7, further comprising a slope trim circuit.

9. The CMOS voltage reference of claim 8, further comprising a level trim circuit.

10. The CMOS voltage reference of claim 9, further comprising a curvature trim circuit.

11. The CMOS voltage reference of claim 10, wherein the slope and level trim circuits sink and/or source current in order to adjust the slope and level, respectively.

12. The CMOS voltage reference of claim 11, wherein the curvature trim circuit comprises at least one resistor that is non-linear over temperature.

13. The CMOS voltage reference of claim 12, further comprising a level select for selecting a desired output voltage level.

14. The CMOS voltage reference of claim 13, wherein the slope, level, and curvature trims are adjusted via a non-volatile memory after the voltage reference is packaged.

15. A CMOS voltage reference comprising:

a band-gap core;

a primary amplifier connected to the band-gap core;

an offset nulling amplifier connected to the primary amplifier, wherein the an input of the offset nulling amplifier is electrically connected to an output of the band-gap core, wherein the offset nulling amplifier receives an output of the band-gap core and integrates a signal from the output of the band-gap core and applies a correction signal to a primary loop of the primary amplifier to force a null at the band-gap cores;

a slope trim circuit; and a level trim circuit;

wherein the slope and level trim circuits sink and/or source current into the band-gap core to adjust the slope and level of an output voltage of the reference.

16. The CMOS voltage reference of claim 15, wherein the nulling amplifier is outside of a signal path of the primary amplifier and nulls offsets and noise associated with the primary amplifier.

17. A CMOS voltage reference comprising:

a band-gap core;

a primary amplifier connected to the band-gap core;

an offset nulling amplifier connected to the primary amplifier;

a slope trim circuit; and a level trim circuit;

a curvature trim circuit, the curvature trim circuit comprising at least one resistor that is non-linear with temperature;

wherein the slope and level trim circuits sink and/or source current into the band-gap core to adjust the slope and level of an output voltage of the reference, wherein the nulling amplifier is outside of a signal path of the primary amplifier and nulls offsets and noise associate with the privy amplifier.

18. A CMOS voltage reference comprising:

a band-gap core;

a primary amplifier connected to the band-gap core;

an offset nulling amplifier connected across the primary amplifier, wherein the an input of the offset nulling amplifier is electrically connected to an output of the band-gap core, wherein the offset nulling amplifier receives an output of the band-gap core and integrates a signal from the output of the band-gap core and applies a correction signal to a primary loop of the primary amplifier to force a null at the band-gap core; and a curvature trim circuit comprising at least one resistor that is non-linear with temperature.

19. The CMOS voltage reference of claim 18, wherein the nulling amplifier is outside of a signal path of the primary amplifier and nulls offsets and noise associated with the primary amplifier.

20. A CMOS voltage reference comprising:

a band-gap core comprising two transistors;

a primary amplifier comprising:

a first gain stage connected to the band-gap core;

a second gain stage connected to the first gain stage;

a third gain stage connected to the second gain stage and the band-gap core;

a current mirror connected to the first, second and third gain stages;

an overall feedback loop comprising the first gain stage, the second gain stage and the third gain stage; and a secondary feedback loop comprising the current mirror, the second gain stage and the third gain stage;

an offset nulling amplifier connected across the primary amplifier;

a slope trim circuit having an output selectably connected to one transistor in the band-gap core;

a level trim circuit connected to the bases of the transistors in the band-gap core; and a curvature trim circuit comprising at least one resistor that is non-linear with temperature.

21. The CMOS voltage reference of claim 20, wherein the slope and level trim circuits sink and/or source current into the band-gap core to adjust the slope and level of an output voltage of the reference.

22. The CMOS voltage reference of claim 21, wherein the nulling amplifier is outside of a signal path of the primary amplifier and nulls offsets and noise associated with the primary amplifier.

* * * * *